US006453493B1

(12) United States Patent
Matthews Brown

(10) Patent No.: US 6,453,493 B1
(45) Date of Patent: Sep. 24, 2002

(54) COVERS FOR SUPPORT PILLOWS

(75) Inventor: Susan H. Matthews Brown, Evergreen, CO (US)

(73) Assignee: The Boppy Company, Golden, CO (US)

( * ) Notice: Subject to any disclaimer, the term of this patent is extended or adjusted under 35 U.S.C. 154(b) by 0 days.

(21) Appl. No.: 09/802,310

(22) Filed: Mar. 8, 2001

(51) Int. Cl.[7] ..... A47G 9/10
(52) U.S. Cl. ..... 5/636; 5/637; 5/645; 5/490
(58) Field of Search ..... 5/636, 637, 640, 5/645, 490

(56) References Cited

U.S. PATENT DOCUMENTS

| | | | | | |
|---|---|---|---|---|---|
| 1,212,515 | A | * | 1/1917 | Leavitt | 5/636 |
| 1,898,272 | A | | 2/1933 | Stern | |
| 2,078,022 | A | | 4/1937 | Roemer | 5/655 |
| 2,379,340 | A | | 6/1945 | Corbett | 4/185 |
| 2,522,120 | A | * | 9/1950 | Kaskey et al. | 5/636 |
| 3,312,987 | A | * | 4/1967 | Emery | 5/636 |
| 3,378,948 | A | | 4/1968 | Gervaise | 5/904 |
| 4,197,604 | A | | 4/1980 | Nakamura | 5/437 |
| 4,236,264 | A | | 12/1980 | Britzman | 5/435 |
| 4,345,347 | A | * | 8/1982 | Kantor | 5/636 |
| 4,731,890 | A | | 3/1988 | Roberts | 5/431 |
| 4,914,765 | A | | 4/1990 | Smith | 5/434 |
| 5,148,564 | A | * | 9/1992 | Reder | 5/636 |
| 5,154,649 | A | | 10/1992 | Pender | 5/655 |
| 5,193,235 | A | | 3/1993 | Kircher | 5/413 |
| 5,207,791 | A | | 5/1993 | Scherbarth | 273/148 B |
| 5,261,134 | A | | 11/1993 | Matthews | 5/655 |
| 5,519,906 | A | | 5/1996 | Fanto-Chan | 5/631 |
| 5,546,620 | A | | 8/1996 | Matthews | 5/655 |
| 5,581,833 | A | | 12/1996 | Zenoff | 5/655 |
| 5,661,861 | A | | 9/1997 | Matthews | 5/633 |
| 6,038,720 | A | | 3/2000 | Matthews et al. | |
| 6,055,687 | A | | 5/2000 | Matthews | |
| 6,119,873 | A | | 9/2000 | Matthews | |

FOREIGN PATENT DOCUMENTS

| | | |
|---|---|---|
| FR | 2 379 268 | 9/1978 |
| GB | 1 508 809 | 4/1978 |
| WO | WO 94/09689 | 5/1994 |

* cited by examiner

*Primary Examiner*—Michael F. Trettel
(74) *Attorney, Agent, or Firm*—Townsend and Townsend and Crew LLP

(57) ABSTRACT

A support pillow comprises a cushion body having a medial region and two opposing arms that define a generally open well, with the cushion body having an outer periphery and an inner periphery adjacent the well. A shell encompasses and tightly conforms to the cushion body. A fabric cover is removably disposed over the shell such that the fabric cover conforms to the shell. The fabric cover defines an opening to permit the cover to be placed over the shell, and the fabric covering includes at least one fastener to close the opening once the cover has been placed over the shell.

20 Claims, 4 Drawing Sheets

Fig. 1
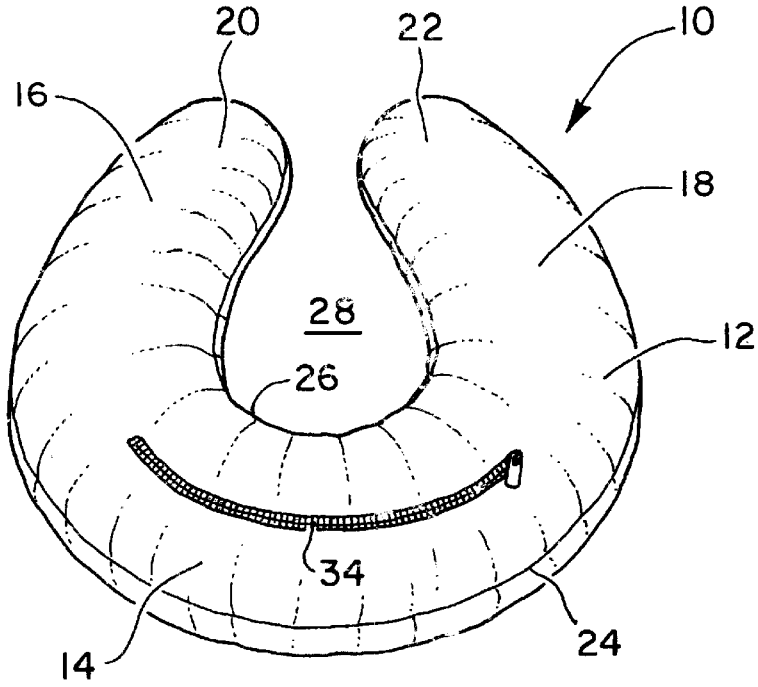
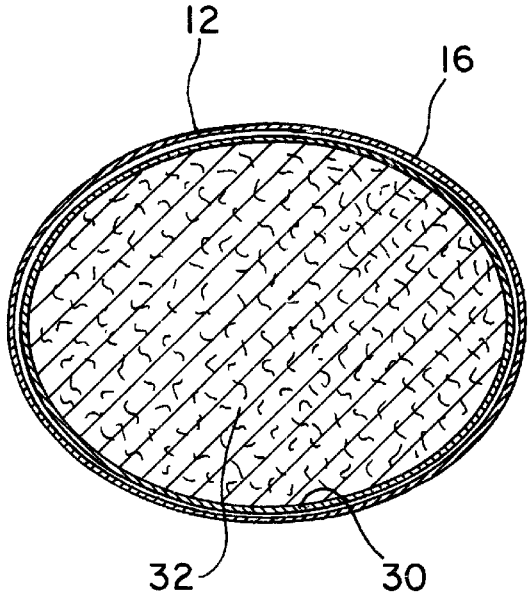
Fig. 2

Fig. 7
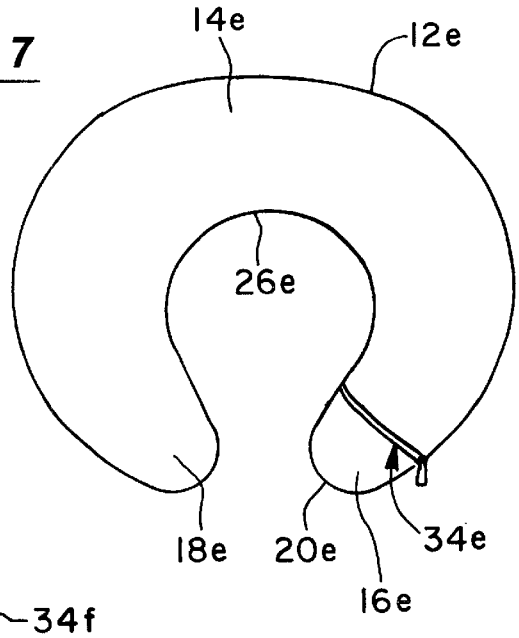
Fig. 8
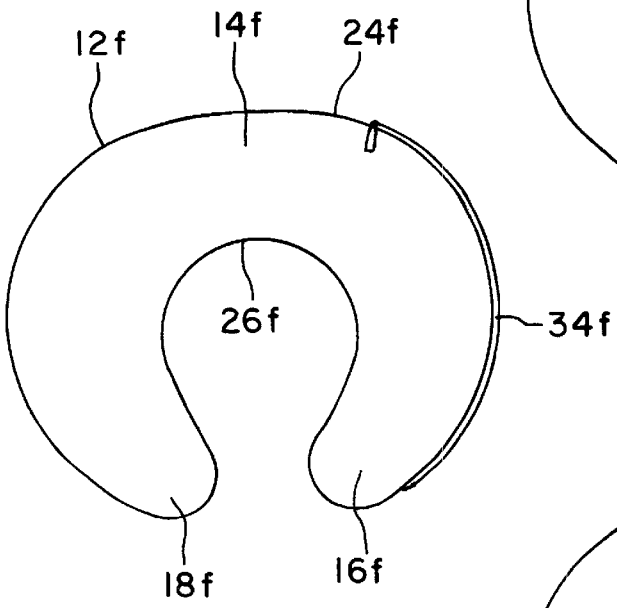
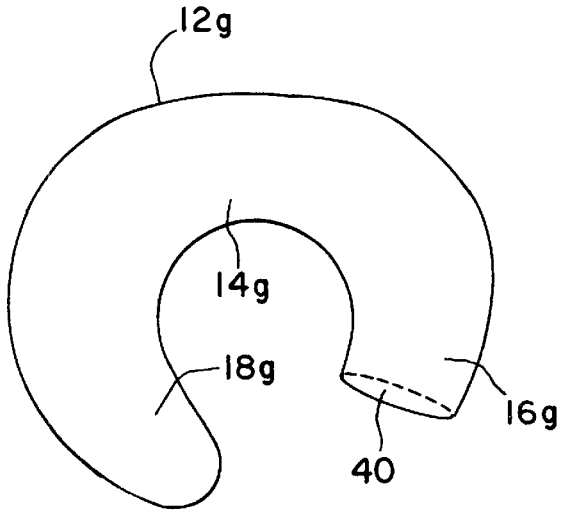
Fig. 9A
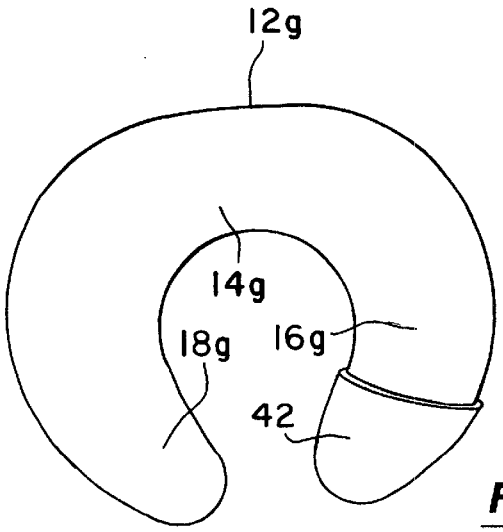
Fig. 9B

COVERS FOR SUPPORT PILLOWS

BACKGROUND OF THE INVENTION

This invention relates generally to the field of support pillows, and in particular to covers for support pillows. More specifically, the invention relates to removable covers for support pillows so that a single support pillow can be modified simply by substituting one cover with another cover.

Support pillows have gained widespread acceptance in a variety of applications. For example, support pillows are now commonly used to support infants and babies in certain positions. Support pillows are also used to provide back support, to facilitate nursing, to support objection in front of a person, and the like. Such uses are described in, for example, U.S. Pat. Nos. 5,261,134; 5,661,861; 6,038,720; 6,055,687; 6,119,873; and 5,546,620, the complete disclosures of which are herein incorporated by reference.

Some support pillows are constructed of a filler material that is stuffed into a fabric shell. This shell may be completely closed, such as with a sewn seam, to prevent the filler material from inadvertently being removed. The fabric shell may be decorated with a variety of colors and/or patterns.

This invention is related to covers for these and other types of support pillows so that the decorative and/or utilitarian functionally of such pillows may to easily be varied.

SUMMARY OF THE INVENTION

The invention provides exemplary covers for support pillows and methods for their use. With such covers, a single support pillow can be modified to have a different color, design, texture, or the like as well as a different utilitarian function.

In one embodiment, the covers are useful with a cushion body having a medial region and two opposing arms that define a generally open well. The cushion body further includes an outer periphery and an inner periphery adjacent the well, with each of the arms terminating in an end. A shell encompasses and tightly conforms to the cushion body. With such support pillows, the fabric cover may be constructed so that it may be placed over the shell, with the fabric cover conforming to the shell. To facilitate placement of the cover over the pillow; the fabric cover includes an opening, and at least one fastener is provided to close the opening once the cover has been placed over the shell. In this way, a support pillow may be modified simply by inserting the pillow into the opening of the cover and then operating the fastener to close the opening.

The opening may be positioned at a wide variety of locations on the cover. For example, the opening may be located along the outer periphery at the medial region, along the inner periphery on one of the arms, along the outer periphery on one of the arms, across the medial region, along one of the ends, or across one of the arms. In one aspect, the fabric cover may comprise a curved tubular member having two ends, where one of the ends is closed and one of the ends is open to define the opening. Such a cover further includes an end flap to cover the opening, and the fastener is used to couple the end flap to the tubular member.

In another aspect, the cushion body is constructed of a fill material that is compressed within the shell. In a further aspect, the shell is constructed of a fabric.

A variety of fasteners may be used to close the opening. For example, the fastener may comprise a zipper, a hook and loop fastener material, or the like. In one optional aspect, at least one peripheral item may be attached to the cover to vary the utility of the pillow. Conveniently, an attachment mechanism may be used to attach the peripheral item to the cover. Merely by way of example, the peripheral item may comprise a toy and the attachment mechanism may comprise a strap. As another example, the peripheral item may comprise a head of a figure, such as an animal head.

The invention also provides a method for covering a support pillow that is similar to the support pillow described above. The method further utilizes a cover that is formed from a curved tubular member having an open interior. According to the method, a fastener on the cover is operated to form or expose an opening in the tubular member to provide access to the interior. The support pillow is placed into the interior of the cover through the opening and the cover is manipulated so that the cover covers the shell and conforms to the shape of the support pillow. The fastener is then operated to close or cover the opening.

By using such a cover, the fastener may be operated to reform or re-expose the opening, and the cover may be removed from the support pillow. Another cover may then be placed over the support pillow in a similar manner.

A variety of techniques may be used to form the opening. For example, a zipper may be unzipped, a flap may be removed from the cover, or the like. In another aspect, a peripheral item may be attached to the cover. For example, the peripheral item may comprise a toy that may be attached by use of a strap that is attached to the cover. In a further aspect, the opening may be formed across the medial region, along one of the arms, along one of the ends, or the like.

BRIEF DESCRIPTION OF THE DRAWINGS

FIG. 1 is a perspective view of one embodiment of a support pillow having a removable cover according to the invention.

FIG. 2 is a cross sectional view of the support pillow and cover of FIG. 1.

FIG. 7 is a top view of one particular embodiment of a pillow cover according to the invention.

FIG. 8 is a top view of a further embodiment of a pillow cover according to the invention.

FIG. 9A is a top view of a pillow cover having an open end according to the invention.

FIG. 9B illustrates the cover of FIG. 9A with an end flap to cover the opening.

DESCRIPTION OF THE SPECIFIC EMBODIMENTS

Figure 3:
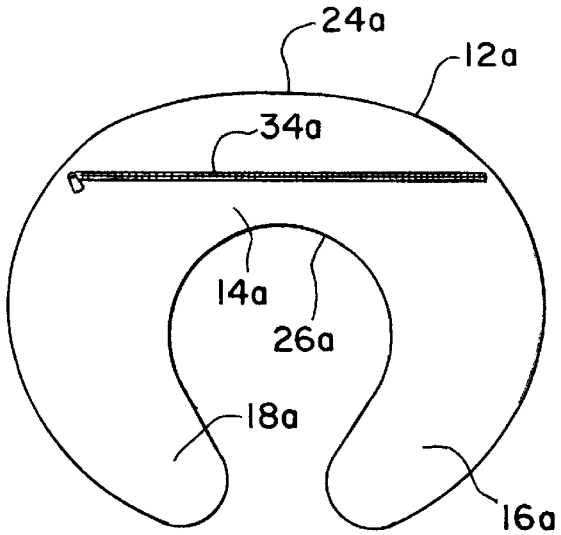
FIG. 3 is a top view of an embodiment of a pillow cover according to the invention.

The invention provides various covers for support pillows. The covers of the invention may be used with a wide variety of support pillows that have generally resilient cushion body. The cushion body may be constructed in a variety of ways and of a variety of materials. One way is to stuff a fill material into a flexible shell, such as a fabric tube. Types of fill materials that may be used include fibers, balls, seeds, foamed materials, elastomers and the like. Some examples of such support pillows are described in U.S. Pat. Nos. 5,261,134; 5,661,861; 6,038,720; 6,055,687; 6,119,873; and 5,546,620, incorporated herein by reference. Other types of cushion bodies include inflatable bladders, sponges, and the like.

The support pillows may also have a variety of shapes and sizes. For example, the support pillow may have a horseshoe shape, a "U" shape, a "∩" shape, straight, semi-circular and the like. Shapes for such pillows are also described in U.S. Pat. Nos. 5,261,134; 5,661,861; 6,038,720; 6,055,687; 6,119,873; and 5,546,620, previously incorporated by reference. Such support pillows may include a variety of decorations. For example, such pillows may include a fabric shell having a certain color or pattern.

The covers of the invention are generally flexible and are used to cover the support pillow. The covers closely conform to the shape of the pillow so that that the pillow maintains she same overall appearance. Examples of materials that may be used to construct the cover include fabrics, such as cotton, polyeater, nylon and the like, plastics, stretchable materials, such as a mesh fabric, LYCRA material, and the like. The covers may include one or more openings through which the support pillows are inserted. Conveniently, one or more fasteners may be used to close the opening after the pillow has been inserted. Examples of fasteners that may be used include zippers, a hook and loop fastener material (also know as VELCRO hook and loop fastener material), snaps, buttons, hooks, laces, elastomers, and the like. In some cases, the covers may include the features described in copending U.S. Application Ser. Nos. 09/679,139, filed Oct. 3, 2000 and 09/802,097, filed on the same date as the present application (attorney docket no. 17242-007310), the complete disclosures of which are herein incorporated by reference.

The covers may have a wide variety of colors, textures, patterns, designs, thicknesses and the like. In this way, an existing support pillow may have its appearance or feel modified simply by placing a cover over the pillow. In some embodiments, the covers may also include various peripheral items that are attached to the covers. Such items can include, for example, toys, teething rings, educational items, pacifiers, play mats, play bars, electronic items such as sound chips, mirrors, writing surfaces, body parts, such as heads, tails, arms legs, and the like, rattles, pockets and the like. Optionally, various attachment mechanisms may be used to attached the peripheral items to the cover. Such attachment mechanisms can include, for example, straps, strings, a hook and loop fastener material, snaps, and the like. Another type of peripheral item is a handle for carrying the support pillow. One example of such a handle is described in copending U.S. Pat. Application Ser. No. 09/002,016 (attorney docket no. 17242-002250), filed on the same date as the present application, the complete disclosure of which is herein incorporated by reference. By using such peripheral items, the utility of the pillow may be changed simply by using another cover having a different set of items.

Referring now to FIG. 1, one embodiment of a support pillow 10 that is covered by a cover 12 will be described. Pillow 10 may be constructed in a manner similar to those described in U.S. Pat. Nos. 5,261,134; 5,661,861; 6,038,720; 6,055,687; 6,119,873; and 5,546,620, incorporated herein by reference. However, the invention is not limited to only this type of support pillow. Pillow 10 has a medial region 14 and two opposing arms 16 and 18 that terminate in ends 20 and 22. Pillow 10 further includes an outer periphery 24 and inner periphery 26 that defines a generally open well 28. As shown, outer periphery 24 and inner periphery 26 have a curved geometry and ends 20 and 22 are generally rounded.

FIG. 2 is a cross sectional view of pillow 10 and cover 12 taken along one of the arms. Pillow 10 is constructed of a shell 30 that is filled or stuffed with a fill material 32, such as hypo allergenic fiber rill material. Shell 30 is filled with enough fill material 32 so that pillow 10 is firm and does not droop or sag during handling. Shell 30 completely encloses fill material 32 so as to prevent its removal.

Cover 12 closely conforms to the shape of pillow 10 so that pillow 10 maintains the same overall shape and appearance as shown. Cover 12 further includes a zipper 34 that may be unzipped to form an opening through which pillow 10 is inserted. Because of the tight fit, cover 12 may be manipulated until it properly covers pillow 10. Zipper 34 may then be zipped to close the opening. As previously described, cover 12 may have a wide variety of colors, textures and the like to vary the appearance or feel of pillow 10.

Cover 12 may be modified to vary the location of zipper 34 (or other fastener). Examples of such variation are illustrated in FIGS. 3–8. For convenience of discussion, the covers in these examples will use the same reference numerals used to describe cover 12, followed by a certain letter. Shown in FIG. 3 is cover 12*a* having a zipper 34*a* that extends across the top side of medial region 14*a*.

Figure 4:
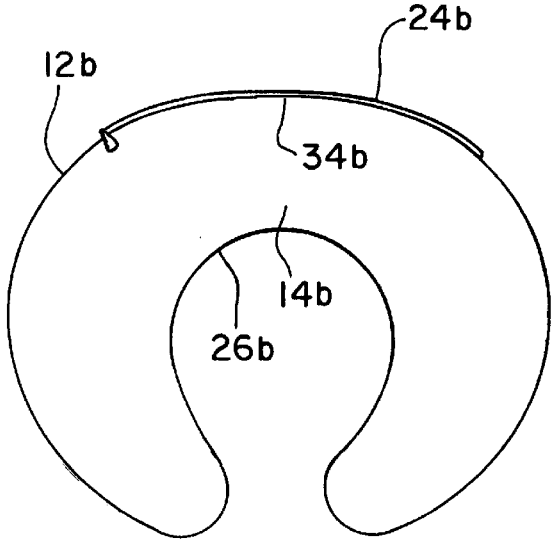
FIG. 4 is a top view of another embodiment of a pillow cover according to the invention.
Figure 5:
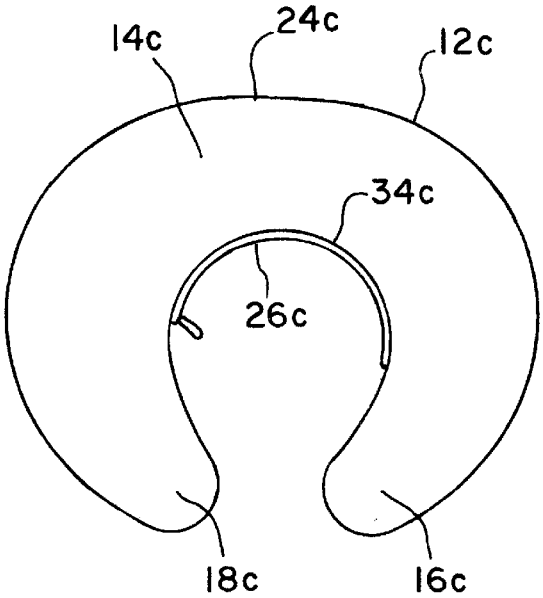
FIG. 5 is a top view of yet another embodiment of a pillow cover according to the invention.
Figure 6:
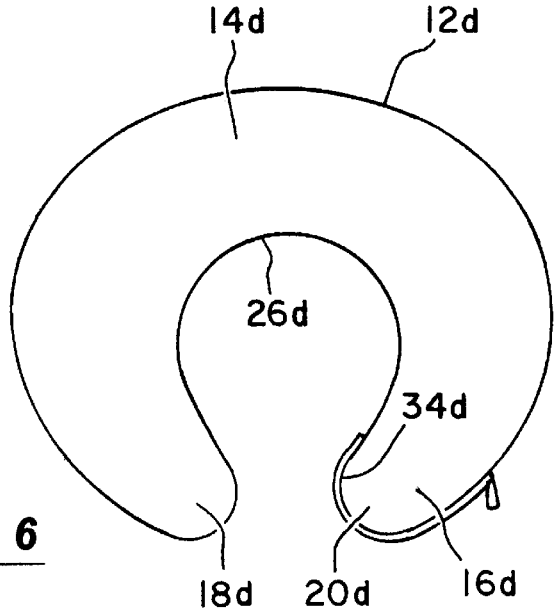
FIG. 6 is a top of still another embodiment of a pillow cover according to the invention.

FIG. 4 illustrates a cover 12*b* having a zipper 34*b* that extends along outer periphery 24*b* at medial region 14*b*. FIG. 5 illustrates a cover 12*c* having a zipper 34*c* that extends along inner periphery 26*c* at medial region 14*c*. FIG. 6 illustrates a cover 12*d* having a zipper 34*d* that extends along end 20*d* of arm 16*d*. FIG. 7 illustrates a cover 12*e* having a zipper 34*e* that extends across the top side of arm 16*e*. Finally, FIG. 8 illustrates a pillow 12*f* having a zipper 34*f* that extends along arm 16*f* at outer periphery 24*f*.

Another embodiment of a cover 12*g* is illustrated in FIGS. 9A and 9B. Cover 12*g* is similar to cover 12*e* of FIG. 7 except that end 20*e* has been removed to leave an opening 40 in arm 16*g*. As shown in FIG. 9B, an end flap 42 is placed over opening 40 to completely enclose the support pillow after the pillow has been inserted through opening 40. A hook and loop fastener material may be used to hold flap 42 to arm 16*g*.

Figure 10:
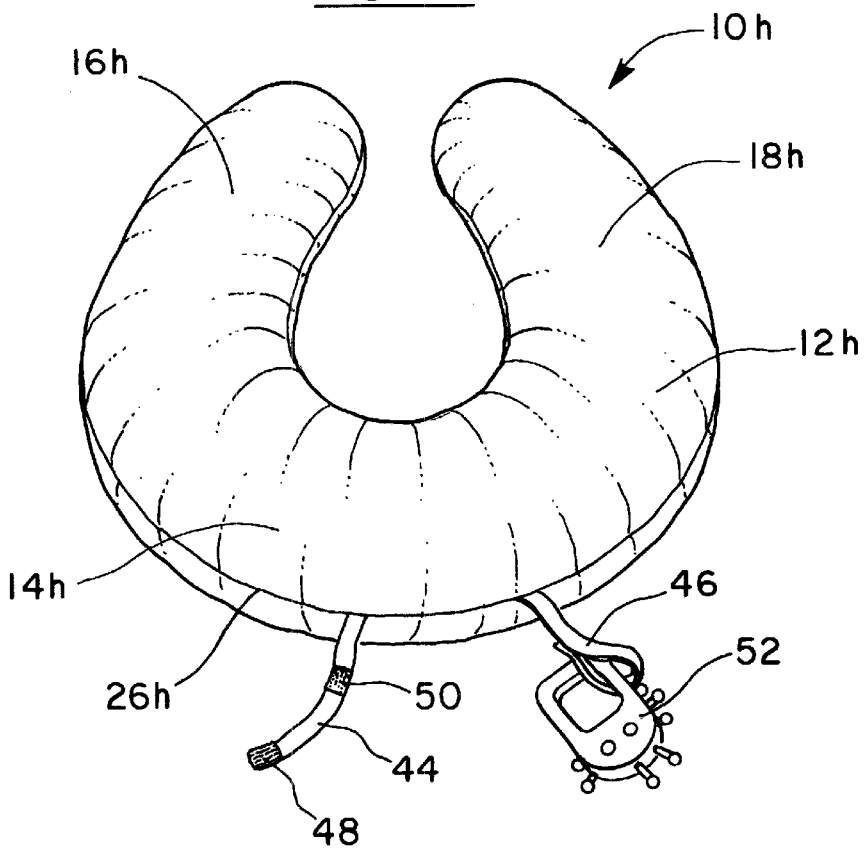
FIG. 10 illustrates a support pillow and cover having straps for attaching items to the cover according to the invention.

FIG. 10 illustrates another modification of support pillow 10 and cover 12 of FIG. 1. For convenience of discussion, similar elements of the support pillow of FIG. 10 and cover will use the same reference numerals, followed by the letter "h". Cover 12*h* has a pair of attachment straps 44 and 46 that are sewn to the seam of outer periphery 24*h*. Straps 44 and 46 include pieces 48 and 50 of a hook and loop fastener material to form loops in straps 44 and 46, it being appreciated that other fasteners may be used. Straps 44 and 46 are used to attach various toys, such as a toy 52, to cover 12*h*. In this way, the utility of pillow 10*h* may be changed simply by attaching different items to the straps. Moreover, other attachment items may be used with the pillow simply by using another cover.

Figure 11:
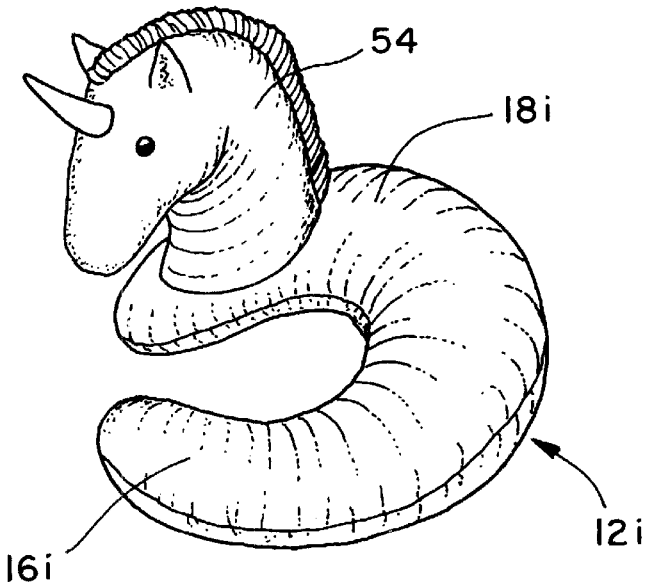
FIG. 11 illustrates a support pillow and cover having an animal head that is attached to the cover according to the invention.

By way of example, FIG. 11 illustrates another embodiment of a cover 12*i* having an animal head 54 attached to end

18*i*. Further, it will be appreciated that other types of figures may be coupled to cover 18*i* and at different locations.

The invention has now been described in detail for purposes of clarity and understanding. However, it will be appreciated that certain changes and modification may be practiced within the scope of the appended claims.

What is claimed is:

1. A support pillow comprising:

a cushion body having a medial region and two opposing arms that define a generally open well, with the cushion body having an outer periphery, an inner periphery adjacent the well, and a pair of opposing faces between the outer periphery and the innerperiphery, and wherein each of the arms terminates in an end;

a shell encompassing and tightly conforming to the cushion body; and a fabric cover removably disposed over the shell such that the fabric cover conforms to the shell, wherein the fabric cover defines an opening to permit the cover to. be placed over the shell, and wherein the fabric covering includes at least one fastener to close the opening once the cover has been placed over the shell; and wherein the opening extends along one of the faces.

2. A support pillow as in claim 1, wherein the opening is located along the outer periphery at the medial region.

3. A support pillow as in claim 1, wherein the opening is located across the medical region.

4. A support pillow as in claim 1, wherein the fabric cover comprises a curved tubular member having two ends, wherein one of the ends is closed and one of the ends is open to define the opening.

5. A support pillow as in claim 1, wherein the opening is located across one of the arms near the end.

6. A support pillow as in claim 1, wherein the cushion body is constructed of a fill material that is compressed within the shell.

7. A support pillow as in claim 1, wherein the shell is constructed of a fabric.

8. A support pillow as in claim 1, wherein the fastener comprises a zipper.

9. A support pillow as in claim 1, wherein the fastener comprises a hook and loop fastener material.

10. A support pillow as in claim 1, further comprising at least one peripheral item attached on the cover.

11. A support pillow as in claim 10, wherein the peripheral item comprises a head of a figure.

12. A support pillow as in claim 10, further comprising at least one attachment mechanism coupled to the cover, and wherein the peripheral item is attached to the cover by the attachment mechanism.

13. A support pillow as in claim 12, wherein the peripheral item is a toy and wherein the attachment mechanism is a strap.

14. A method for covering a support pillow, the method comprising:

providing a support pillow that comprises a cushion body having a medial region and two opposing arms that define a generally open well, with the cushion body having an outer periphery, an inner periphery adjacent the well, and a pair of opposing faces between the outer periphery and the inner periphery and wherein each of the arms terminates in an end, and a shell encompassing and tightly conforming to the cushion body;

providing a cover that comprises a curved tubular member having an open interior;

operating a fastener on the cover to form or expose an opening in the tubular member to provide access to the interior, wherein the opening extends across one of the faces;

placing the support pillow into the interior of the cover through the opening and manipulating the cover so that the cover covers the shell and conforms to the shape of the support pillow; and operating the fastener to close or cover the opening.

15. A method as in claim 14, further comprising operating the fastener to form or expose the opening, removing the cover from the support pillow, and placing another cover over the support pillow.

16. A method as in claim 14, wherein the fastener operating step comprises unzipping a zipper.

17. A method as in claim 14, further comprising attaching a peripheral item to the cover.

18. A method as in claim 17, wherein the peripheral item comprises a toy, and wherein the attaching step comprise securing a strap to the toy that is attached to the cover.

19. A method as in claim 14, further comprising forming the opening across the medial region.

20. A method as in claim 14, further comprising forming the opening along one of the arms.

* * * * *